US010191428B2

(12) United States Patent
Yamazaki et al.

(10) Patent No.: US 10,191,428 B2
(45) Date of Patent: Jan. 29, 2019

(54) IMAGE FORMING APPARATUS PERFORMING MISREGISTRATION CORRECTION CONTROL BASED ON DETECTION RESULTS OF DETECTION PATTERN

(71) Applicant: CANON KABUSHIKI KAISHA, Tokyo (JP)

(72) Inventors: Hiroyuki Yamazaki, Mishima (JP); Takuya Mukaibara, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/496,412

(22) Filed: Apr. 25, 2017

(65) Prior Publication Data

US 2017/0329267 A1 Nov. 16, 2017

(30) Foreign Application Priority Data

May 13, 2016 (JP) ..... 2016-097388

(51) Int. Cl.
*G03G 15/00* (2006.01)
*G03G 15/01* (2006.01)

(52) U.S. Cl.
CPC ..... *G03G 15/5054* (2013.01); *G03G 15/0189* (2013.01); *G03G 15/5058* (2013.01); *G03G 2215/0161* (2013.01)

(58) Field of Classification Search
CPC ..... G03G 2215/0161; G03G 15/5058; G03G 15/0189; G03G 15/0131
See application file for complete search history.

(56) References Cited

U.S. PATENT DOCUMENTS

| | | | | |
|---|---|---|---|---|
| 8,010,026 | B2 | 8/2011 | Kobayashi et al. | |
| 9,213,290 | B2 | 12/2015 | Koyama et al. | |
| 9,244,415 | B2 | 1/2016 | Yamaguchi et al. | |
| 9,576,229 | B2 | 2/2017 | Hosoya et al. | |
| 2014/0321890 | A1* | 10/2014 | Hagiwara | G03G 15/0189 399/301 |
| 2015/0286179 | A1* | 10/2015 | Sugiyama | G03G 15/5025 399/49 |
| 2015/0293488 | A1 | 10/2015 | Mukaibara et al. | |

FOREIGN PATENT DOCUMENTS

| | | | |
|---|---|---|---|
| JP | 2001-356542 | A | 12/2001 |
| JP | 2008-112132 | A | 5/2008 |
| JP | 2015-055784 | A | 3/2015 |
| JP | 2015-197469 | A | 11/2015 |

* cited by examiner

*Primary Examiner* — Walter L Lindsay, Jr.
*Assistant Examiner* — Jessica L Eley
(74) *Attorney, Agent, or Firm* — Venable LLP

(57) ABSTRACT

An image forming apparatus performs misregistration correction based on a detection result of a detection pattern. The detection pattern includes basic patterns arranged at a first interval in a sub-scanning direction. Each basic pattern includes N image groups arranged at a second interval. In the N image groups, a first group including an image at a first angle and a second group including an image at a second angle are arranged alternately in the sub-scanning direction. The first interval corresponds to a distance that a surface of an image carrier moves in a period of M times a first period corresponding to a rotation period of a rotational member, and the second interval corresponds to a distance that a surface of the image carrier moves in a period of 1/(N−1) of the first period.

14 Claims, 13 Drawing Sheets

IMAGE FORMING APPARATUS PERFORMING MISREGISTRATION CORRECTION CONTROL BASED ON DETECTION RESULTS OF DETECTION PATTERN

BACKGROUND OF THE INVENTION

Field of the Invention

The present invention relates to an image forming apparatus such as a printer, a copier, a recorder, a facsimile machine, or the like configured to form an image based on an image signal.

Description of the Related Art

Recently, printing using an image forming apparatus employing an electrophotographic scheme has become widespread. In a color image forming apparatus employing a so-called tandem scheme, in which image forming units of respective colors are provided independently, a misregistration can occur when images have been layered, due to mechanical factors or environmental factors in the image forming units of respective colors. When a misregistration occurs, edge blurring and color unevenness occur, and so image quality deteriorates. More specifically, a stable misregistration (referred to below as a DC color shift) can occur in a configuration in which a light scanning unit and a photosensitive member are respectively provided in image forming units configured to form toner images of respective colors.

In order to correct a DC color shift, the image forming apparatus transfers toner images (referred to below as a "detection pattern") for detecting a misregistration amount from the photosensitive members to a transfer belt, detects the relative positions of the toner images of the respective colors using a sensor, and performs misregistration correction based on detection results. However, due to factors such as eccentricity of rollers that drive the photosensitive members and the transfer belt, unevenness of the thickness of the transfer belt, or the like, periodic fluctuations in rotational speed occur at the photosensitive members or the transfer belt. Due to these rotational speed fluctuations, an unstable misregistration (referred to below as an AC color shift), in which the misregistration amount changes depending on the position where the detection pattern is formed on the transfer belt, occurs. When an AC color shift occurs, a detection error occurs in the misregistration amount based on the detection results of the detection pattern. In order to suppress detection errors due to an AC color shift, it is conceivable to form a plurality of detection patterns within one period of an AC color shift and average detection results of these detection patterns. Japanese Patent Laid-Open No. 2001-356542 discloses an arrangement of a detection pattern for simultaneously canceling periods of a belt drive roller and a drive source of the belt drive roller.

In the image forming apparatus, there are cases where there are a plurality of rotational members that cause an AC color shift. Also, there are cases where, from one rotating member, not only does an AC color shift of a period of one revolution of that rotating member occur, but also a harmonic AC color shift of a ½ or ⅓ period component of that one revolution, occurs. In such a case, in the image forming apparatus, an AC color shift of a plurality of periods occurs. Also, there may be cases where the change over time of an AC color shift does not have the form of a sine wave. In order to suppress these AC periods, it is necessary to form many detection patterns, but the amount of toner consumed increases. Also, after a detection pattern is detected, it is necessary to remove the detection pattern on the transfer belt, so the burden on a cleaning unit increases. Furthermore, only a limited quantity of detection patterns can be placed within a limited area.

SUMMARY OF THE INVENTION

According to an aspect of the present invention, an image forming apparatus, includes: a forming unit configured to form a detection pattern on a rotationally drivable image carrier; a detection unit configured to detect the detection pattern; and a control unit configured to perform misregistration correction control based on a detection result of the detection pattern by the detection unit. The detection pattern includes a plurality of basic patterns arranged at a first interval in a sub scanning direction, which is a rotation direction of the image carrier, and each of the plurality of basic patterns includes N image groups (N being an integer of at least 3) arranged at a second interval in the sub scanning direction. In the N image groups, a first image group including an image at a first angle relative to the sub scanning direction, and a second image group including an image at a second angle different from the first angle relative to the sub scanning direction, are arranged alternately in the sub scanning direction. The first interval corresponds to a distance that a surface of the image carrier moves in a period of M (M being an integer of at least 2) times a first period corresponding to a rotation period of a rotational member included in the forming unit, and the second interval corresponds to a distance that the surface of the image carrier moves in a period of 1/(N−1) of the first period.

Further features of the present invention will become apparent from the following description of exemplary embodiments with reference to the attached drawings.

DESCRIPTION OF THE EMBODIMENTS

Following is a description of exemplary embodiments of the present invention with reference to the drawings. Note that the following embodiments are only examples, and the present invention is not limited to the content of the embodiments. Also, in the following drawings, configuration elements that are not necessary to describe the embodiments are omitted from the drawings.

First Embodiment

Figure 1:
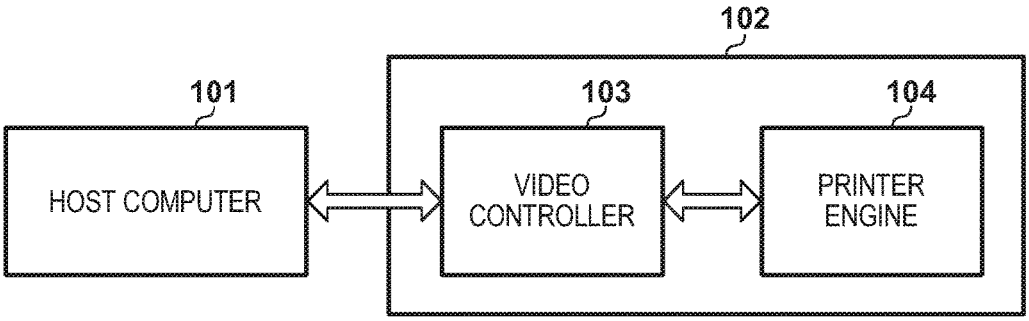
FIG. 1 shows the overall configuration of an image forming apparatus according to one embodiment.

FIG. 1 shows the configuration of a system including an image forming apparatus 102 according to the present embodiment. When a host computer 101 transmits image data to the image forming apparatus 102 and instructs image forming, the image forming apparatus 102 performs image forming. When image forming is instructed from the host computer 101, a video controller 103 performs various data processing such as color conversion and halftone processing, transmits the processed image data to a printer engine 104, and instructs image forming. When image forming is instructed from the video controller 103, the printer engine 104 controls a mechanism unit of the image forming apparatus shown in FIG. 2 according to image data that is received, and performs image forming on a recording medium.

Figure 2:
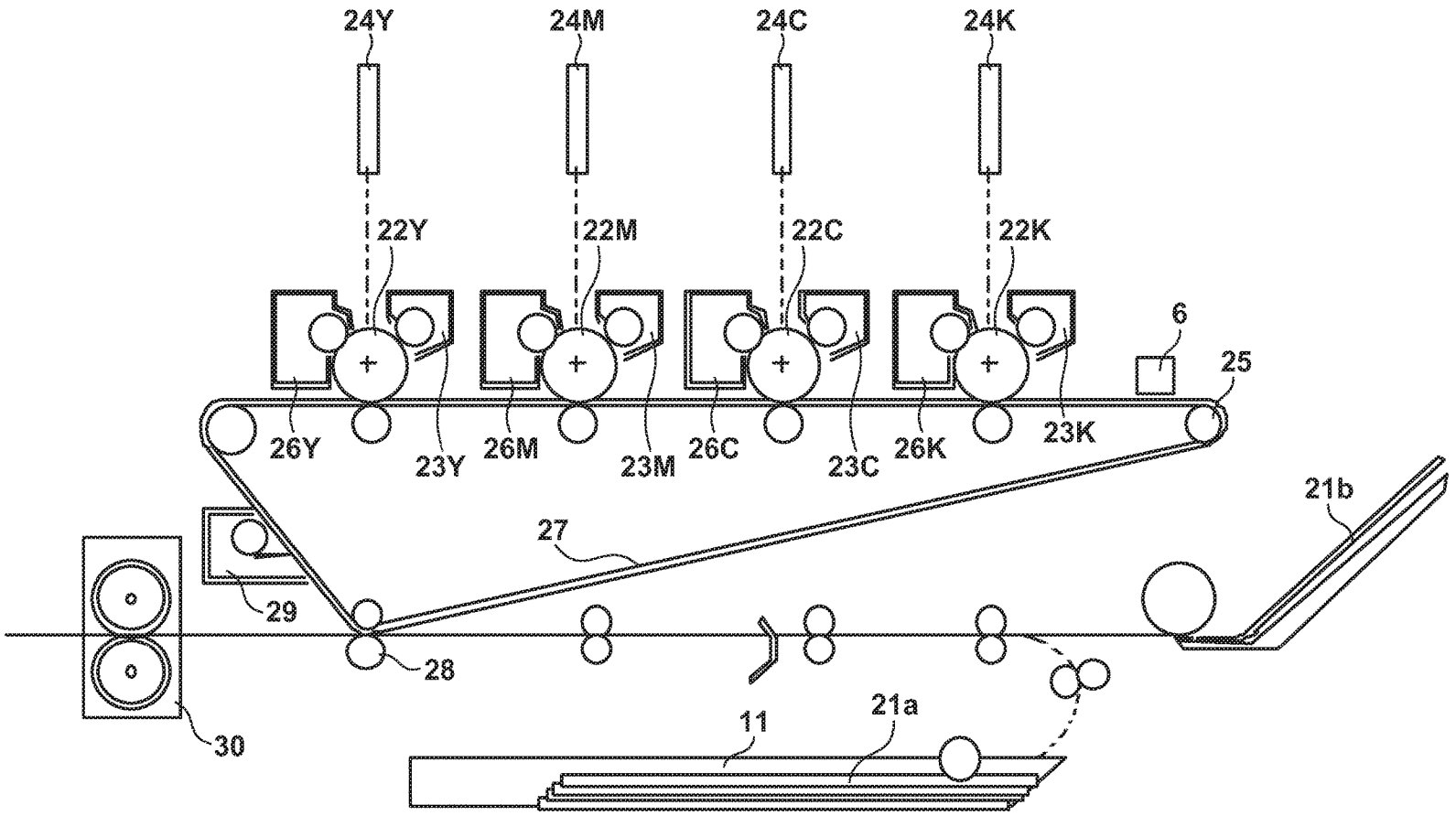
FIG. 2 shows a mechanism unit of an image forming apparatus according to one embodiment.

FIG. 2 is a cross-sectional view showing the mechanism unit of the image forming apparatus controlled by the printer engine 104. In FIG. 2, letters Y, M, C, and K at the end of reference signs respectively indicate that the colors of toner images formed by corresponding members are yellow, magenta, cyan, and black. Note that in the following description, when it is not necessary to distinguish between colors, reference signs excluding the letter at the end are used. Photosensitive members 22 are rotationally driven in the counterclockwise direction of the drawing when forming an image. Exposure units 23 charge the surface of the photosensitive members 22 to a uniform potential. Light scanning units 24 form electrostatic latent images by exposing the photosensitive members 22 charged to a uniform potential based on image data. Development units 26 develop the electrostatic latent images formed on the photosensitive members 22 with toner to make the electrostatic latent images visible as toner images. The toner images of the photosensitive members 22 are transferred to a transfer belt 27, which is an image carrier. By layering the toner images of each photosensitive member 22 and transferring them to the transfer belt 27, a full color toner image is formed on the transfer belt 27.

The transfer belt 27 is driven to rotate in the clockwise direction of the drawing by a drive roller 25 when performing image formation. Thus, the toner image of the transfer belt 27 is carried to a position facing a transfer roller 28. On the other hand, a recording medium 11 of a cassette 21*a* or a tray 21*b* is conveyed to a position facing the transfer roller 28 at the same timing that the toner image of the transfer belt 27 is carried to a position facing the transfer roller 28. Then, the transfer roller 28 transfers the toner image of the transfer belt 27 to the recording medium 11 conveyed along the conveyance path. A cleaning unit 29 removes toner remaining on the transfer belt 27 without being transferred to the recording medium 11. After transfer of the toner image, the recording medium 11 is conveyed to a fixing unit 30. The fixing unit 30 applies heat and pressure to the recording medium 11 to fix the toner image on the recording medium 11. After fixing the toner image, the recording medium 11 is discharged outside of the image forming apparatus. A sensor 6 is provided at a position facing the transfer belt 27 and detects a detection pattern.

Figure 3:
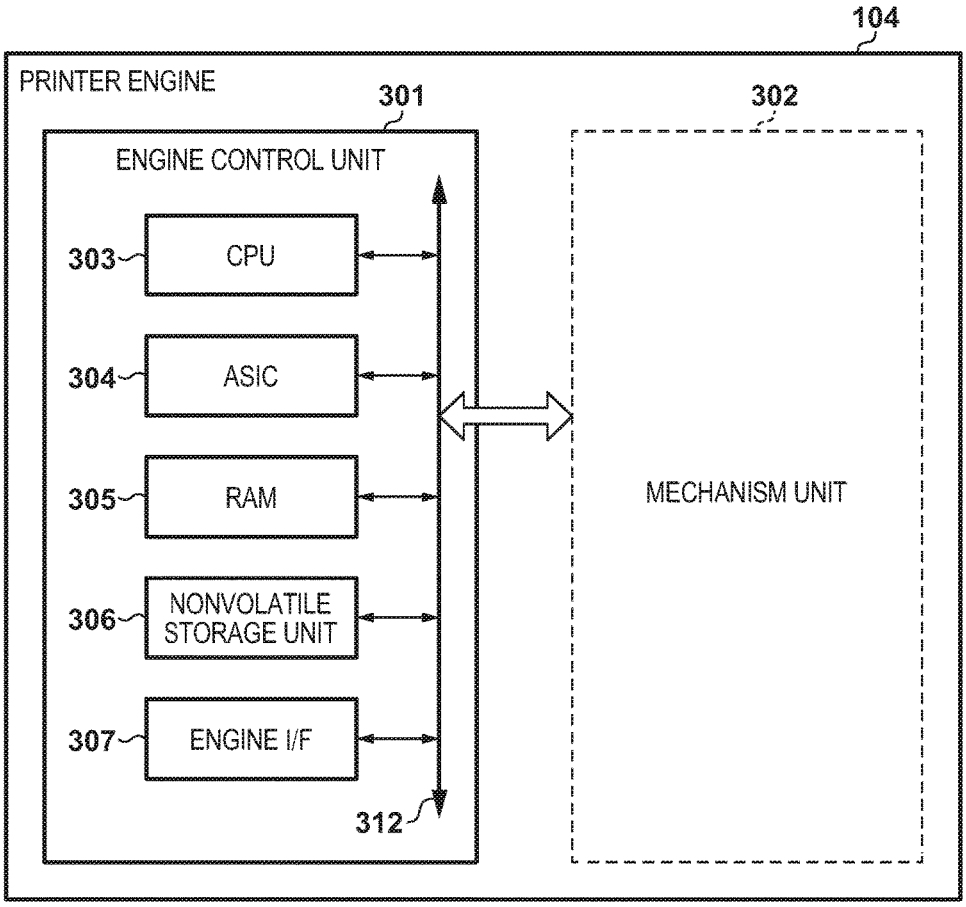
FIG. 3 shows the configuration of a printer engine according to one embodiment.

FIG. 3 is a schematic configuration diagram of the printer engine 104. An engine control unit 301 of the printer engine 104 controls a mechanism unit 302 shown in FIG. 2 to perform image forming. A CPU 303, using a RAM 305 as a main memory and a work area, performs control of the mechanism unit according to various control programs that can be stored in a nonvolatile storage unit 306. An ASIC 304 also controls the mechanism unit in cooperation with the CPU 303, under instruction by the CPU 303. An engine interface unit (I/F) 307 is a communications unit configured to communicate with the video controller 103. The functional blocks of the engine control unit 301 are configured so as to be capable of communicating with each other through a system bus 312. Note that the ASIC 304 may be caused to perform some or all of the functions of the CPU 303, and conversely, the CPU 303 may be caused to perform some or all of the functions of the ASIC 304. Also, a configuration may be adopted in which separate dedicated hardware is provided, and that dedicated hardware is caused to perform some of the functions of the CPU 303 or the ASIC 304.

Figure 4A:
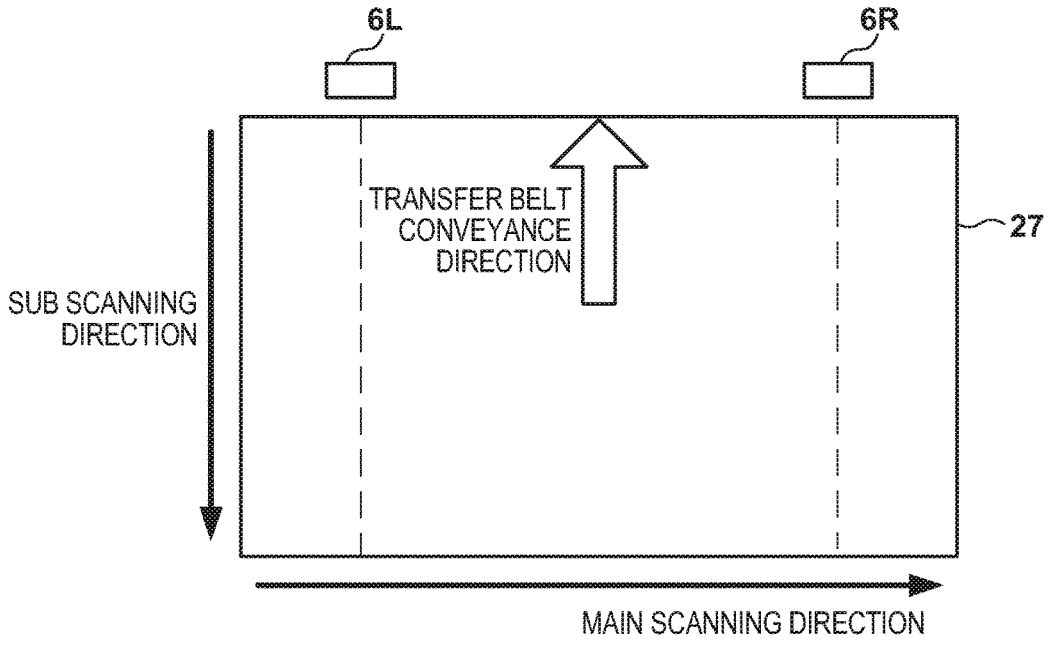
FIGS. 4A and 4B illustrate a sensor according to one embodiment.
Figure 4B:
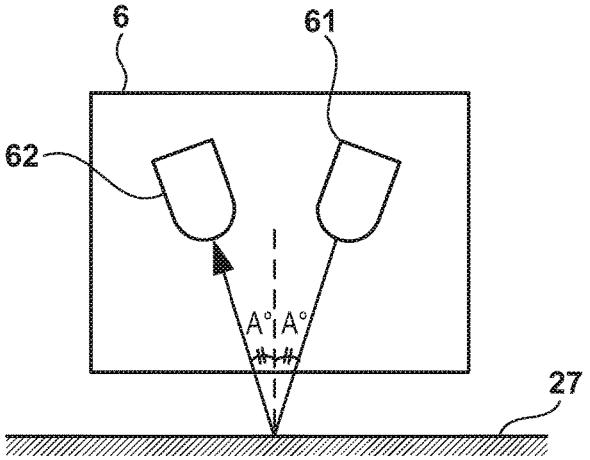

FIGS. 4A and 4B illustrate the sensor 6 according to the present embodiment. As shown in FIG. 4A, a sensor 6 is provided at each end in a direction orthogonal to the conveyance direction of the transfer belt 27. One of these sensors is referred to as a sensor 6L, and the other is referred to as a sensor 6R. However, if it is not necessary to distinguish between the two sensors, they are referred to as the sensor 6. FIG. 4B shows the configuration of the sensor 6. A light emitting unit 61 is, for example, an LED, and irradiates light toward the transfer belt 27. A light receiving unit 62 is, for example, a phototransistor, and receives light that is irradiated by the light emitting unit 61 and reflected by a surface of the transfer belt 27 or reflected on a detection pattern that has been formed on that surface. Note that the light emitting unit 61 and the light receiving unit 62 are each disposed inclined by an angle A relative to the normal direction of the transfer belt 27 so as to be optically symmetrical. Therefore, the light receiving unit 62 mainly receives specular reflection light reflected by the transfer belt 27. Note that a configuration may also be adopted in which another light receiving unit that detects diffuse reflection light is additionally provided.

Figure 5:
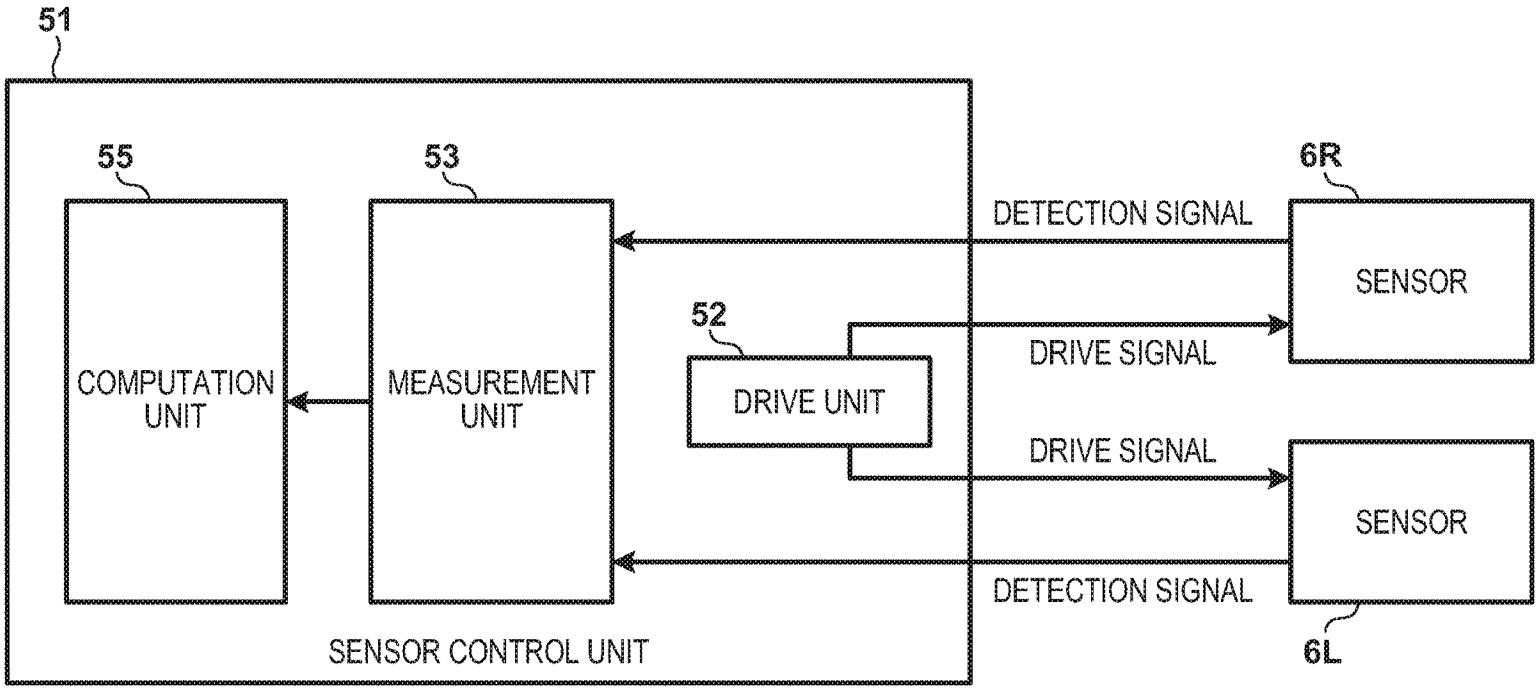
FIG. 5 shows the configuration of a sensor control unit according to one embodiment.

FIG. 5 shows a control configuration of the sensor 6 according to the present embodiment. A sensor control unit 51 can be realized by the ASIC 304, for example. However, the sensor control unit 51 may also be realized by the CPU 303. A drive unit 52 outputs a drive signal for switching on/off the sensors 6R and 6L. When the sensors 6R and 6L are in an on state, the light emitting unit 61 irradiates light, and the light receiving unit 62 outputs a detection signal indicating an intensity of received light or an amount of received light. A measurement unit 53 receives the detection signal output by the sensors 6R and 6L, and by comparing this signal to a threshold value, measures a detection timing of toner images of each color of a detection pattern. A computation unit 55 computes a misregistration amount based on the detection timing of the toner images of each color of the detection pattern, and calculates a correction parameter for correcting the misregistration. Note that in the present embodiment, the detection signal output by the sensor 6 is a signal corresponding to the intensity of received light of the light receiving unit 62, and the measurement unit 53, by comparing the detection signal to a threshold value, calculates the detection timing of the toner images of each color of the detection pattern. However, a configuration may also be adopted in which the sensor 6 performs comparison to a threshold value within the sensor 6, and outputs a binary signal as a detection signal to the measurement unit 53. In this case, the measurement unit 53 detects the detection timing of the toner images of each color of the detection pattern based on an edge of the binary signal.

Next is a description of the detection pattern used in the present embodiment. Note that in FIGS. 7A and 7B, open arrows indicate the rotational direction, that is, the sub scanning direction, of the transfer belt 27. Also, the direction orthogonal to the sub scanning direction is the main scanning direction, that is, the scanning direction of the photosensitive members 22 by the light scanning units 24. Also, in FIGS. 7A and 7B, reference sign 701 indicates the detection position of the sensor 6.

Figure 7A:
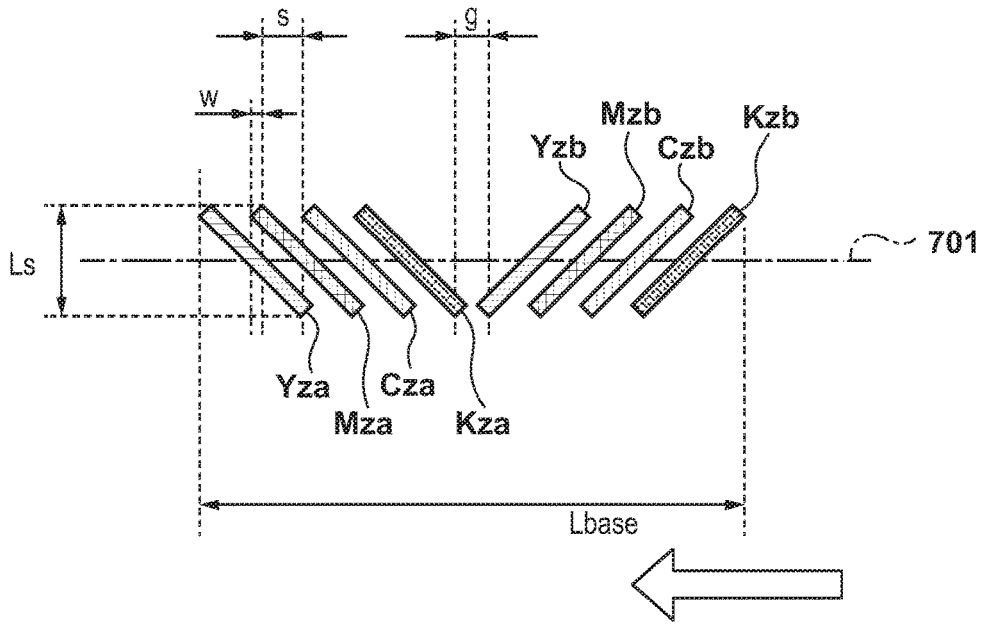
FIGS. 7A and 7B illustrate a detection pattern according to one embodiment.

FIG. 7A has diagonal lines Yza, Mza, Cza, and Kza of each color at 45 degrees relative to the sub scanning direction and diagonal lines Yzb, Mzb, Czb, and Kzb of each color at −45 degrees relative to the sub scanning direction. Note that the first letters Y, M, C, and K of the character strings indicating the diagonal lines respectively indicate that the toner colors are yellow, magenta, cyan, and black. Also, in the following description, an image group including the diagonal lines Yza, Mza, Cza, and Kza is referred to as a first image group, and an image group including the diagonal lines Yzb, Mzb, Czb, and Kzb is referred to as a second image group. Furthermore, when not distinguishing between the first image group and the second image group, these are collectively referred to as an image group. In the present embodiment, the first image group and the second image group are linearly symmetrical relative to the sub scanning direction.

Figure 7B:
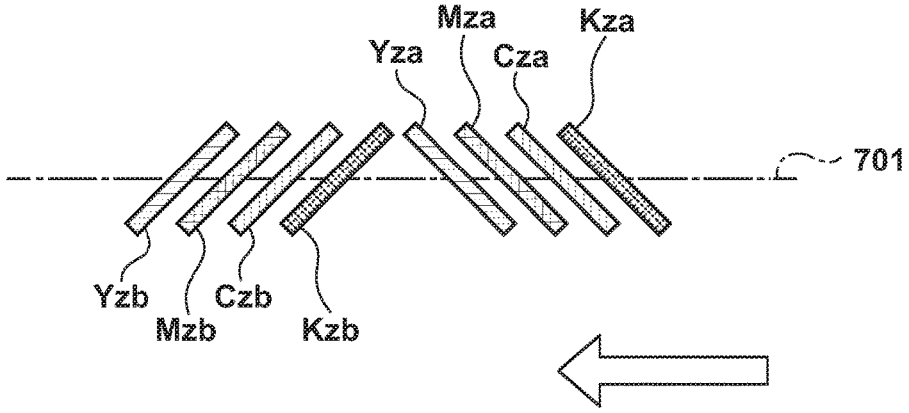

In the pattern shown in FIG. 7A, the second image group is arranged to the rear side of the first image group in the sub scanning direction, and in the pattern shown in FIG. 7B, the second image group is arranged to the front side of the first image group in the sub scanning direction. Note that the front side is the side detected earlier by the sensor 6, and is also referred to as the downstream side. On the other hand, the rear side is the side that is detected later by the sensor 6 and is also referred to as the upstream side. In the present embodiment, in an ideal state without misregistration, the width in the sub scanning direction of each diagonal line in the image group is denoted as w, and the width in the sub scanning direction of a portion where the toner does not affix between two adjacent diagonal lines in one image group is denoted as s. Also, the shortest distance in the sub scanning direction between the last diagonal line of the image group on the front side and the first diagonal line of the image group on the rear side is denoted as g. Furthermore, the length in the main scanning direction of each diagonal line is denoted as Ls. In this case, Lbase, which is the length in the sub scanning direction of the patterns shown in FIGS. 7A and 7B, equals w×8+s×6+Ls×2+g. For example, when w=2 (mm), s=4 (mm), g=4 (mm), and Ls=12 (mm), the length Lbase in the sub scanning direction of the patterns shown in FIGS. 7A and 7B equals 68 (mm). Note that the image forming apparatus, in an ideal state, forms a detection pattern such that the center in the main scanning direction of each diagonal line comes to the detection position of the sensor 6.

Next is a description of how to calculate a misregistration amount in the sub scanning direction and the main scanning direction based on detection results of the pattern shown in FIG. 7A. Note that in the following description, the detection position of each diagonal line in the pattern is represented by adding d to the character string indicating each diagonal line in FIG. 7A. That is, for example, the detection position of the diagonal line Yza is represented as dYza. Note that how to calculate the detection position of each diagonal line will be described later. Also, in the following description, it is assumed that black is used as a reference color, and misregistration amounts for each of yellow, magenta, and cyan relative to black are calculated.

First, the misregistration amount in the sub scanning direction of yellow can be calculated by the following formula.

$$|(dYza+dYzb)/2-(dKza+dKzb)/2|-3\times(w+s)$$

In the above formula, an ideal distance in the sub scanning direction of yellow and black is subtracted from the distance between an average position of the yellow diagonal lines of the first image group and the second image group and an average position of the black diagonal lines of the first image group and the second image group. Note that in the above formula, a negative misregistration amount indicates that the distance between yellow and black in the sub scanning direction is less than the ideal distance, in other words, yellow is shifted to the upstream side in the sub scanning direction. On the other hand, a positive misregistration amount indicates that the distance between yellow and black in the sub scanning direction is more than the ideal distance, in other words, yellow is shifted to the downstream side in the sub scanning direction. The misregistration amount in the sub scanning direction of magenta and cyan can also be calculated using the same thought process. Also, note that the ideal distance between magenta and black is 2×(w+s), and the ideal distance between cyan and black is (w+s).

Also, the misregistration amount in the main scanning direction of yellow can be calculated by the following formula.

$$(|dKzb-dKza|-|dYzb-dYza|)/2$$

Figure 8A:
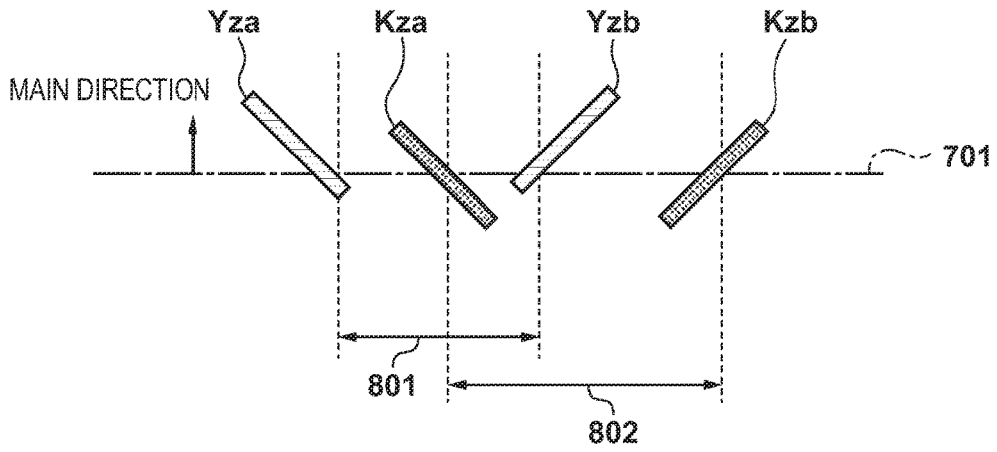
FIGS. 8A and 8B illustrate determination of a misregistration amount in a main scanning direction according to one embodiment.

As shown in FIG. 8A, |dKzb−dKza| in the above formula indicates a distance 802 in the sub scanning direction of the black diagonal lines of the first image group and the second image group. Similarly, |dYzb−dYza| indicates a distance 801 in the sub scanning direction of the yellow diagonal lines of the first image group and the second image group. Accordingly, the numerator of the above formula indicates a value obtained by subtracting the distance 801 from the distance 802. In the present embodiment, the absolute value of the angle of the diagonal lines relative to the sub scanning direction is 45 degrees, so the difference between the distance 802 and the distance 801 is twice the misregistration amount in the main scanning direction. Accordingly, by dividing the value obtained by subtracting the distance 801 from the distance 802 by two, the misregistration in the main scanning direction can be calculated. As is clear from FIG. 8A, when yellow shifts to the positive side relative to black, the distance 801 becomes smaller than the distance 802. Note that in the present embodiment, the direction of the arrow in FIG. 8A indicates a shift to the positive side. Accordingly, in the present embodiment, by subtracting the distance 801 from the distance 802, the sign of the calculated value indicates the direction of shift. This is similarly true for magenta and cyan.

Figure 8B:
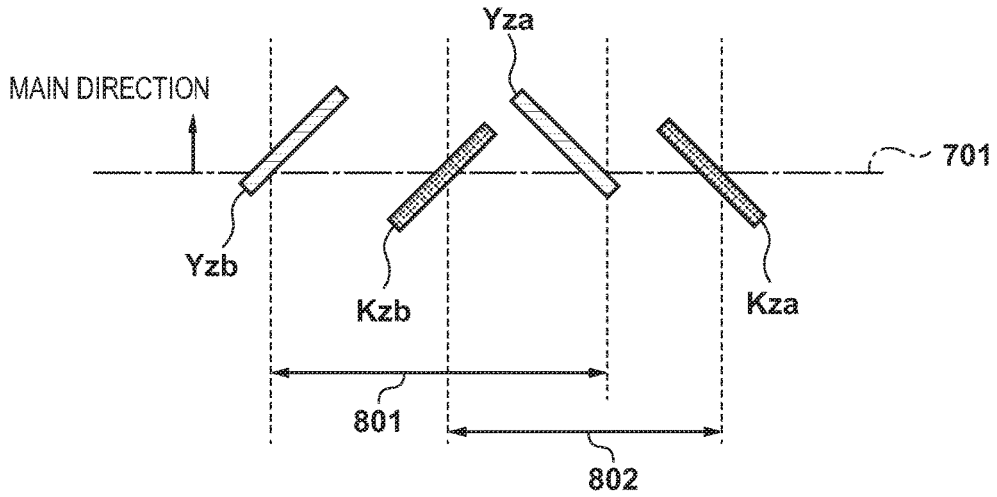

Next is a description of how to calculate a misregistration amount in the sub scanning direction and the main scanning direction based on detection results of the pattern shown in FIG. 7B. How to calculate the misregistration amount in the sub scanning direction is similar to the calculation for the pattern in FIG. 7A. On the other hand, regarding the main scanning direction, how to calculate the absolute value of the misregistration amount is the same, but the relationship between the sign and the direction of shift differs from the pattern in FIG. 7A. The reason for this is that, as shown in FIG. 8B, when yellow shifts to the positive side relative to black, the distance 801 becomes longer than distance 802. That is, in the pattern in FIG. 7B, if the result of calculation by the same calculation formula as the pattern in FIG. 7A is a negative value, yellow is shifted to the positive side.

Based on the above, a detection pattern according to the present embodiment will be described with reference to FIG. 9. In the image forming apparatus according to the present embodiment, an AC color shift due to rotational unevenness is presumed to occur in three periods, specifically, a period in which a photosensitive member 22 completes one revolution, a half period of the photosensitive member that is a double harmonic of the one revolution period, and a period in the transfer belt 27 completes one revolution. Note that, in order to simplify the description below, although the period is a time period, each period is indicated by a movement amount of the surface of the transfer belt 27 in the corresponding period. Specifically, the movement amount of the surface of the transfer belt 27 during one revolution of the photosensitive member 22 is referred to as a drum period Ld, and the movement amount of the surface of the transfer belt 27 during one rotation of the transfer belt 27 is referred to as a belt period Lb. Also, a period of ½ of the drum period Ld is referred to as a drum half period. As a concrete numerical example, below, Ld=108 (mm) and Lb=900 (mm) are used.

Figure 9:
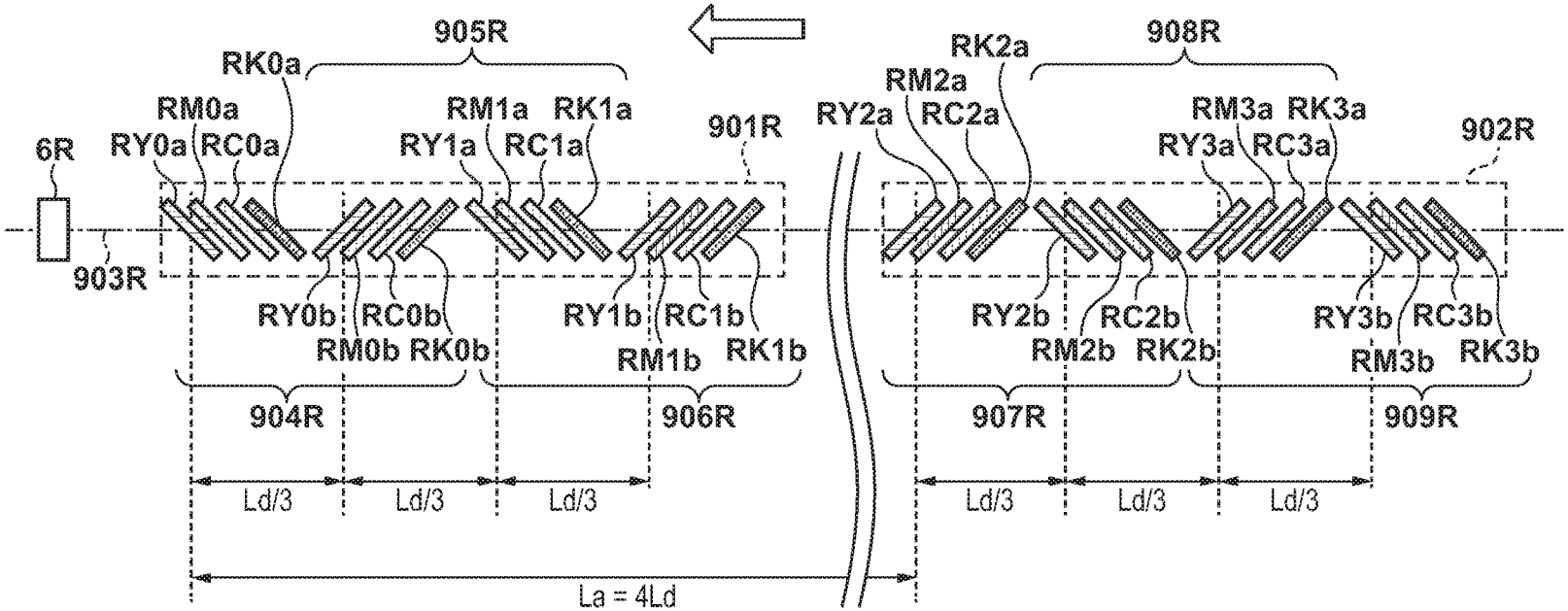
FIG. 9 shows a detection pattern according to one embodiment.

FIG. 9 shows the detection pattern in the present embodiment. In FIG. 9, only the detection pattern that the sensor 6R detects is shown, but actually, a similar detection pattern can also be formed at the detection position of the sensor 6L. Note that the open arrow in FIG. 9 indicates the conveyance direction of the transfer belt 27, that is, the sub scanning direction. In the present embodiment, the detection pattern includes a basic pattern 901R and a basic pattern 902R. In the basic patterns 901R and 902R, respectively, the first image group and the second image group are arranged alternately in the sub scanning direction. In the present embodiment, the basic patterns 901R and 902R each include four image groups, and the interval between two adjacent image groups in the sub scanning direction is set to ⅓ of the drum period Ld. Note that the interval between two adjacent image groups in the sub scanning direction is the distance between a diagonal line in the front side image group and a diagonal line of the same color in the rear side image group, at a predetermined position in the main scanning direction. In the present embodiment, the predetermined position is the center position in the main scanning direction of the diagonal lines. Commonly speaking, when forming a quantity of N image groups (N being an integer of at least 3) in one basic pattern, the interval between image groups in the sub scanning direction is set to 1/(N−1) of the drum period Ld. Also, in the present embodiment, an interval La between the basic patterns in the sub scanning direction is set to be four times the drum period Ld. Note that the interval La between the basic patterns in the sub scanning direction is the distance between a diagonal line at the head of the front side basic pattern and a diagonal line at the head of the rear side basic pattern, at the center position in the main scanning direction.

As is clear from FIG. 9, groups 904R and 906R of two adjacent image groups of the basic pattern 901R constitute the pattern of FIG. 7A, and a group 905R of two adjacent image groups constitute the pattern of FIG. 7B. Similarly, groups 907R and 909R of two adjacent image groups of the basic pattern 902R constitute the pattern of FIG. 7B, and a group 908R of two adjacent image groups constitute the pattern of FIG. 7A. Note that in the following description, parameters related to the size and interval of the image groups are as shown in FIG. 7A, and in the following description, as specific numerical values, w=2 (mm), s=4 (mm), g=4 (mm) and Ls=12 (mm) are used. Also, in the following description, when specifying each diagonal line, the character strings attached to each diagonal line in FIG. 9 are used.

As described above, the distance between the diagonal line RY0*a* and the diagonal line RY0*b* on the detection position 903R of the sensor 6R is set to one third of the drum period Ld, as shown in FIG. 9. When applying the above exemplary numerical values, the distance between the diagonal line RY0*a* and the diagonal line RY0*b* is w×4+s×3+Ls+g=36 (mm), and this is one third of the drum period Ld=108 (mm). Also, as described above, the distance La between the basic patterns 901R and 902R is Ld×4=432 (mm).

Next, how to calculate a misregistration amount in the sub scanning direction and the main scanning direction based on the detection results of the detection pattern in FIG. 9 will be described. Note that in the following description, the detection position of each diagonal line of the detection pattern is represented by adding d to the character string indicating each diagonal line in FIG. 9. That is, for example, the detection position of the diagonal line RY0*a* is expressed as dRY0*a*. Note that how to calculate the detection position of each diagonal line will be described later. Also, in the following description, black is used as the reference color, and the misregistration amounts of each of yellow, magenta, and cyan relative to black are calculated.

First, how to calculate the misregistration amount in the sub scanning direction will be described. The basic thought process is similar to that described with reference to FIGS. 7A and 7B. However, as described above, in the present embodiment, there are a total of six groups of the patterns described in FIGS. 7A and 7B. Accordingly, the misregistration amounts in the sub scanning direction calculated from the detection results of each group of patterns are averaged. As a representative example, the method of calculating the misregistration amount dRYs of yellow in the sub scanning direction is shown below.

$$dRYs=|(dRY0a+dRY0b)+(dRY0b+dRY1a)+(dRY1a+dRY1b)+(dRY2a+dRY2b)+(dRY2b+dRY3a)+(dRY3a+dRY3b)-(dRK0a+dRK0b)-(dRK0b+dRK1a)-(dRK1a+dRK1b)-(dRK2a+dRK2b)-(dRK2b+dRK3a)-(dRK3a+dRK3b)|/12-3\times(w+s)$$

Magenta and cyan are similar, except that the ideal distance from black is different.

Next, how to calculate the misregistration amount in the main scanning direction will be described. Similar to the sub scanning direction, the misregistration amounts in the main scanning direction calculated from the detection results of six groups of patterns are averaged. As a representative example, the method of calculating the misregistration amount dRYm of yellow in the main scanning direction is shown below.

$$dRYm=(|dRK0b-dRK0a|-|dRK1a-dRK0b|+|dRK1b-dRK1a|-|dRK2b-dRK2a|+|dRK3a-dRK2b|-|dRK3b-dRK3a|)/12-(|dRY0b-dRY0a|-|dRY1a-dRY0b|+|dRY1b-dRY1a|-|dRY2b-dRY2a|+|dRY3a-dRY2b|-|dRY3b-dRY3a|)/12$$

Note that the reason the signs are different when calculating the average values for black and yellow is that the relationship between the sign and the direction of misregistration is inverse in the patterns in FIGS. 7A and 7B.

Figure 6:
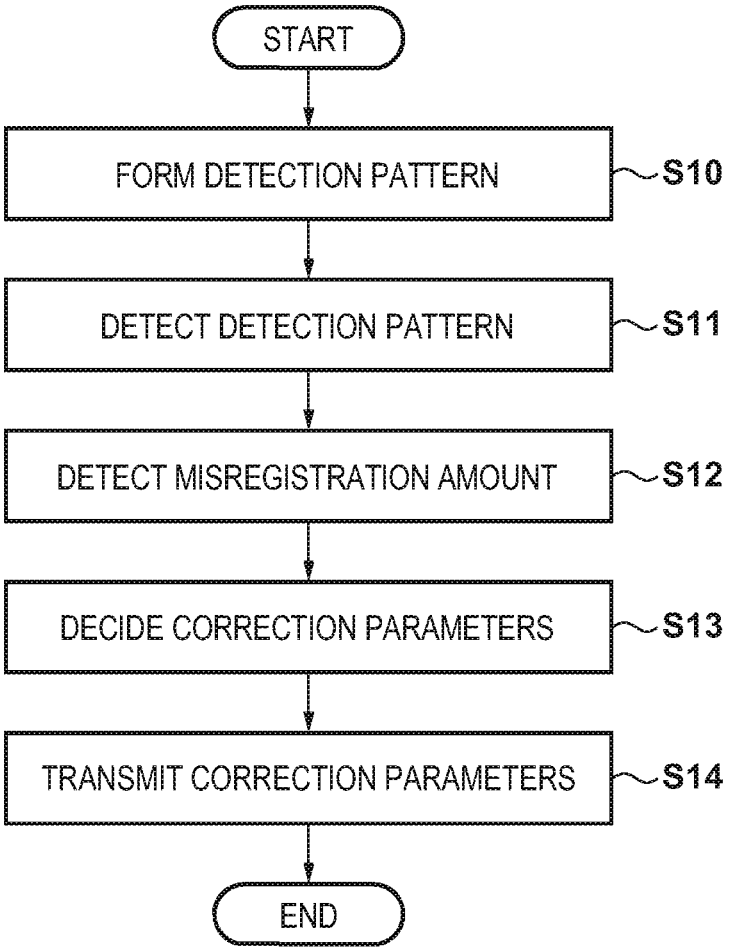
FIG. 6 is a flowchart of misregistration correction processing according to one embodiment.
Figure 10:
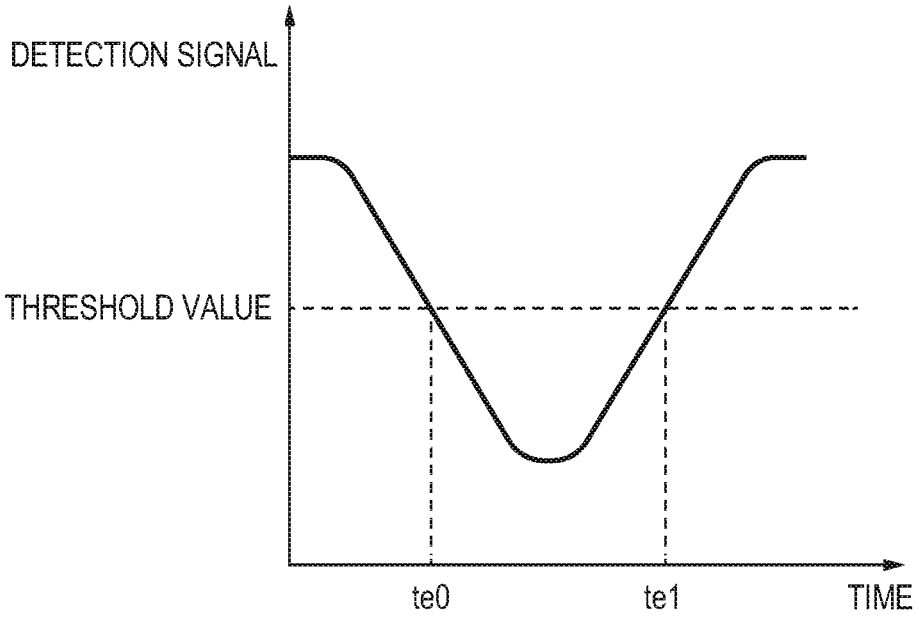
FIG. 10 illustrates a principle of detecting a toner image of a detection pattern according to one embodiment.

FIG. 6 is a flowchart of misregistration correction processing according to the present embodiment. Note that the image forming apparatus starts the misregistration correction processing when a predetermined condition is satisfied. A predetermined condition is satisfied, for example, when power is turned on, when a predetermined quantity of sheets of paper have been printed since previous misregistration correction processing, when a predetermined time period has elapsed since previous misregistration correction processing, or when the temperature inside of the apparatus has fluctuated by at least a predetermined value. However, other conditions can also be used. After starting misregistration correction, in step S10, the CPU 303 controls the mechanism unit 302 to form the detection pattern of FIG. 9 on the transfer belt 27. In step S11, the measurement unit 53 detects the detection pattern based on a detection signal. FIG. 10 shows a detection signal when a toner image corresponding to one diagonal line has passed through the detection area of the sensor 6. As shown in FIG. 10, specular reflection light in the toner image is weaker than specular reflection light on the surface of transfer belt 27, so when the toner image passes through the detection area of the sensor 6, the detection signal temporarily decreases. The measurement unit 53 compares the detection signal to the threshold value, and sets a timing te0 at which the detection signal dropped below the threshold value as the detection timing of the edge on the front side of the toner image. Then, the measurement unit 53 sets a timing te1 at which the detection signal rose above the threshold value as the detection timing of the edge on the rear side of the toner image. The measurement unit 53, from these two detection timings te0 and te1, calculates the position of the detected diagonal lines as (te0+te1)/2×Vp. Here, Vp represents the movement speed (mm/sec) of the surface of the transfer belt 27.

In step S12, the computation unit 55 calculates misregistration amounts in the sub scanning direction and the main scanning direction for the sensors 6R and 6L as described above, based on the position of each diagonal line of the detection pattern detected by the sensors 6R and 6L. Then, based on the misregistration amount in the sub scanning direction and the main scanning direction calculated based on the detection results of the sensor 6R, and the misregistration amount in the sub scanning direction and the main scanning direction calculated based on the detection results of the sensor 6L, a sub scanning misregistration amount, a main scanning misregistration amount, a main scanning width, and an inclination amount are each calculated. Following is a description of how to calculate a sub scanning misregistration amount, a main scanning misregistration amount, a main scanning width and an inclination amount for the color yellow, as a representative example. Note that the misregistration amounts of yellow in the sub scanning direction and the main scanning direction calculated from the detection results of the sensor 6R are represented as dRYs and dRYm, and the misregistration amounts of yellow in the sub scanning direction and the main scanning direction calculated from the detection results of the sensor 6L are represented as dLYs and dLYm.

First, the sub scanning misregistration amount dYs of yellow is calculated as the average value of dRYs and dLYs. That is, $$dYs=(dRYs+dLYs)/2.$$

Similarly, the main scanning misregistration amount dYm of yellow is calculated as the average value of dRYm and dLYm. That is, $$dYm=(dRYm+dLYm)/2.$$

The main scanning width dYw of yellow is an expansion/contraction amount of the main scanning width of yellow relative to the reference color black, calculated from $$dYw=dRYm-dLYm,$$

and the slope amount dYk of yellow is the inclination amount of a scanning line relative to the reference color black, calculated from $$dYk=dRYs-dLYs.$$

In step S13, the computation unit 55 calculates correction parameters based on the sub scanning misregistration amount, the main scanning misregistration amount, the main scanning width, and the inclination amount of each color. Specifically, from the "sub scanning misregistration amount", an adjustment amount of exposure timing of the photosensitive member 22 for canceling the misregistration in the sub scanning direction is calculated. From the "main scanning misregistration amount", an adjustment amount of exposure start timing in the main scanning direction for canceling the misregistration amount in the main scanning direction is calculated. From the "main scanning width", a correction expansion/contraction factor of the main scanning width, for canceling a shift in the main scanning width, is calculated. From the "inclination amount", an inclination correction angle for canceling inclination of the scanning line is calculated. In step S14, the computation unit 55 transmits the correction parameters to the video controller 103, and the video controller 103 records the correction parameters in an unshown nonvolatile storage unit. When performing image forming, the video controller 103 instructs the printer engine 104 to perform image forming based on the stored correction parameters.

Figure 11:
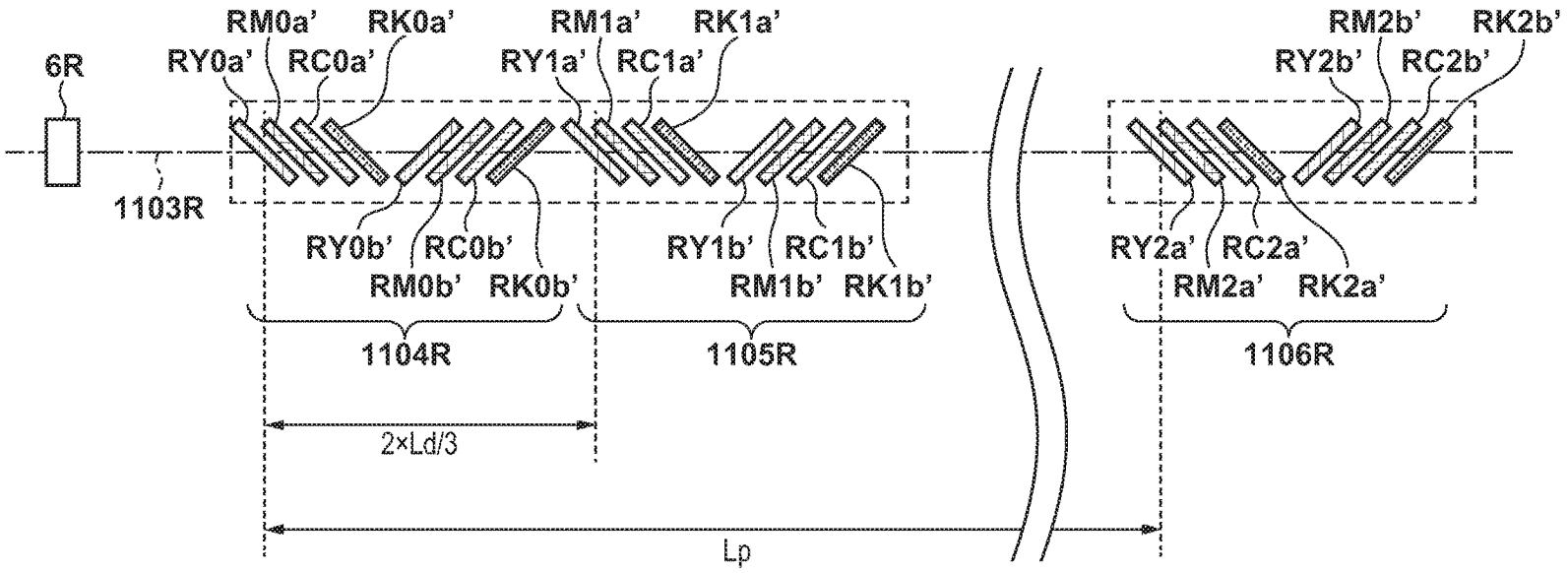
FIG. 11 shows a detection pattern.

Next, advantages of the present embodiment will be described. For example, the length in the sub scanning direction of the pattern in FIG. 7A or 7B is (mm). Accordingly, it is not possible to arrange the pattern in FIG. 7A or 7B with an interval of ⅓ of the drum period Ld (108 (mm)), that is, an interval of 36 (mm). Therefore, the detection pattern shown in FIG. 11 is conceivable. In the detection pattern shown in FIG. 11, three of the pattern in FIG. 7A are arranged in the sub scanning direction. Note that the interval in the sub scanning direction of a pattern 1104R and a pattern 1105R is ⅔ of the drum period Ld, and the interval Lp between the pattern 1104R and the pattern 1106R is defined as Lp=Ld×4+Ld/3. Accordingly, the three patterns are arranged in a phase obtained by dividing the drum period Ld into three equal parts. Accordingly, AC color shift in a drum period and a drum half period can be reduced by averaging the detection results of each of the three patterns.

When the above specific numerical values are applied, Lp is 468 (mm), which is a value close to 450 (mm), which is half the belt period Lb (900 (mm)). In other words, the pattern 1104R and the pattern 1106R are in a position close to the inverse phase of the belt period. However, due to the presence of the pattern 1105R, the influence of the AC color shift in the belt period cannot be reduced by averaging the detection results of the three patterns. Also, there are cases where the waveform of the AC color shift does not have the form of a sine wave, and in such a case, the AC color shift is not sufficiently suppressed by averaging only three groups relative to the drum period Ld, so the influence of the AC color shift in the drum period and the drum half period cannot be sufficiently reduced.

On the other hand, in the present embodiment, as described with reference to FIG. 9, an image group other than the first and last image groups in the basic pattern are combined with each of the image group of the front side and the image group of the rear side, and the misregistration amount is calculated with this combination. That is, the interval of three groups of one basic pattern is an interval that is ⅓ of the drum period. Furthermore, the interval La between basic patterns is La=Ld×4. That is, each of the three patterns of the basic pattern of the front side is in the same phase with each of the three patterns of the basic pattern of the rear side. Accordingly, by averaging the detection results of the 6 patterns, it is possible to reduce the AC color shift of the drum period and the drum half period.

Furthermore, the interval La of the two basic patterns is La=4×Ld=432 (mm), which is close to ½ of the belt period, which is 450 (mm). Also, as described above, each of the three groups of the two basic patterns is in the same phase. Averaging the six groups of detection results corresponds to calculating an average of the average of the detection results of the three groups of the basic pattern 901R and the average of the detection results of the three groups of the basic pattern 902R. Accordingly, the AC color shift of the belt period can be reduced by averaging the detection results from the six patterns. Furthermore, in the present embodiment, because the average of six patterns, which is more than in the configuration of FIG. 11, is calculated, the misregistration can be effectively reduced even when the AC color shift does not have the form of a sine wave.

As described above, in the present embodiment, one image group is used in common between two patterns, so it is possible to reduce the influence of a plurality of AC color shifts within a limited length.

Note that in the present embodiment, the interval between the basic pattern 901R and the basic pattern 902R is set to be four times the drum period, and this is decided based on the belt period Lb=900 (mm) of the transfer belt. More specifically, M times the drum period Ld (M being an integer of at least 2) is compared to a value obtained by dividing the belt period Lb=900 (mm) by an integer, and the value of M is decided such that the difference between those values is small. Furthermore, the quantity of basic patterns to form is decided based on the belt period Lb, the drum period Ld, and the decided value M. Specifically, in this example, M is set to 4 because 432 (mm), which is four times the drum period Ld, is close to 450 (mm), which is obtained by dividing the belt period Lb by 2. Also, the value 2 used to divide the belt period Lb is set as the quantity of basic patterns to form. Also, in the present embodiment, the quantity N of image groups in the basic pattern is set to 4, but the value of N is not limited to 4, and it is possible to select an arbitrary quantity N of at least 3 according to the properties of the image forming apparatus.

Second Embodiment

Figure 12A:
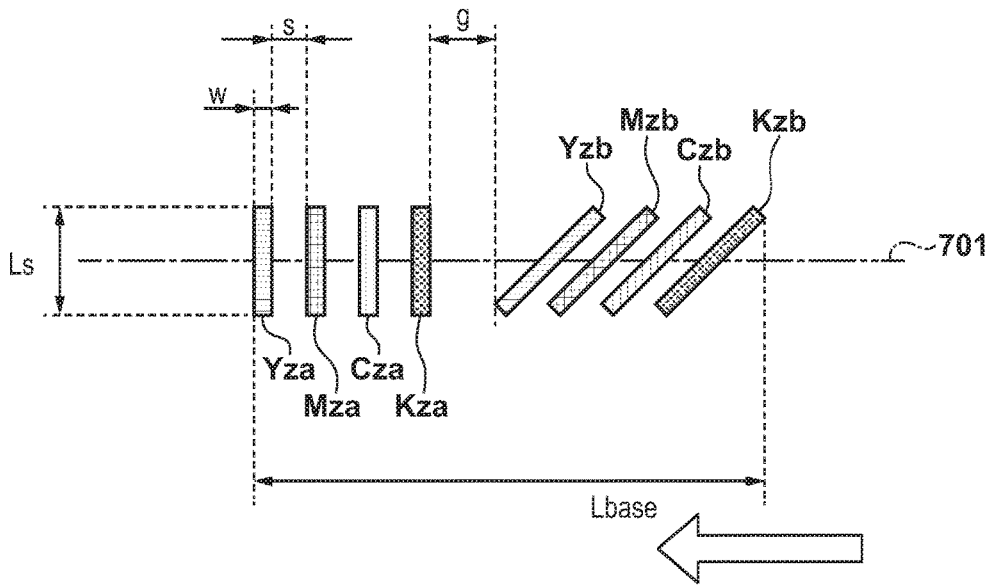
FIGS. 12A and 12B illustrate a detection pattern according to one embodiment.
Figure 12B:
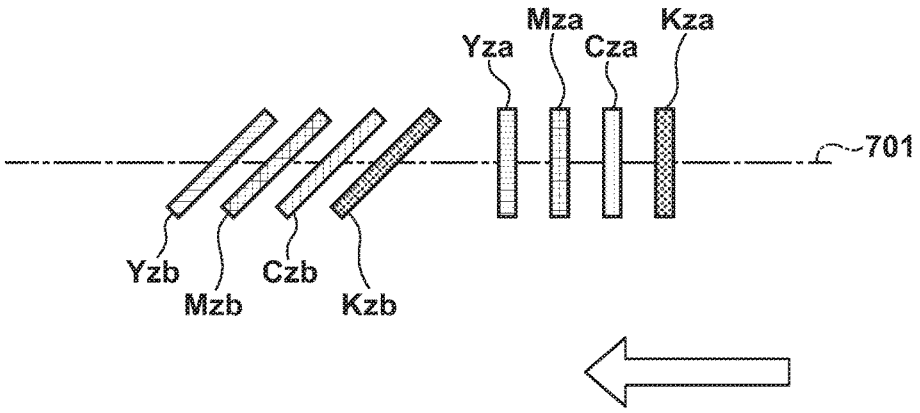

Next, a second embodiment will be described with focus on differences from the first embodiment. FIGS. 12A and 12B are diagrams in which the angle of each image of the first image group in FIGS. 7A and 7B relative to the sub scanning direction is 90 degrees. As is clear from FIGS. 12A and 12B, by changing the angle of the first image group, the length Lbase in the sub scanning direction can be made shorter than in the first embodiment. Note that the method of calculating the misregistration amount in the sub scanning direction is the same as in the first embodiment. On the other hand, the misregistration amount in the main scanning direction, for example, is calculated from the following formula for yellow.

$$(|dKzb-dKza|-|dYzb-dYza|)$$

In the first embodiment, the angle of each image of the first image group is 45 degrees relative to the sub scanning direction, but in the present embodiment, the angle is 90 degrees, so the portion to be divided by 2 in the first embodiment is eliminated. Other aspects are similar to first embodiment.

Third Embodiment

Figure 13:
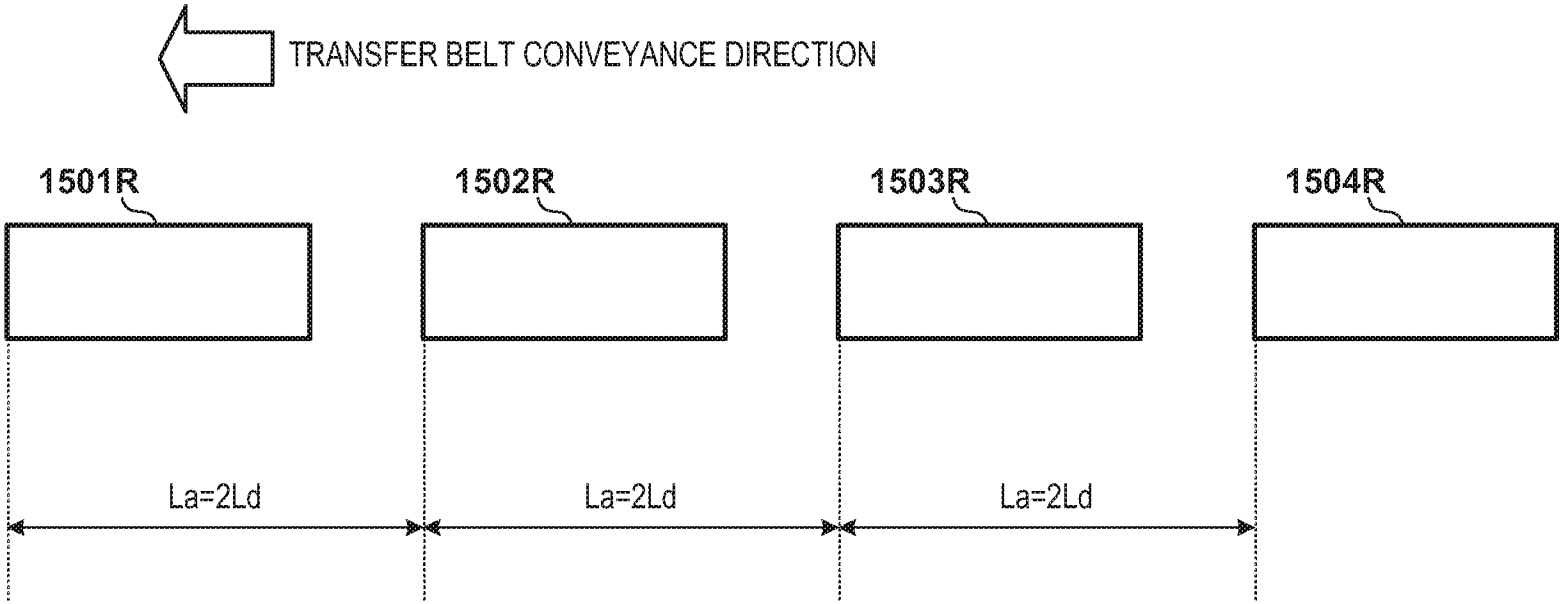
FIG. 13 illustrates a detection pattern according to one embodiment.

Next, a third embodiment will be described with focus on differences from the first embodiment and the second embodiment. FIG. 13 shows a detection pattern according to the present embodiment. In the present embodiment, four basic patterns 1501R, 1502R, 1503R and 1504R are formed. As the basic patterns 1501R and 1503R, patterns similar to the basic pattern 901R in FIG. 9 of the first embodiment above are formed. Also, as the basic patterns 1502R and 1504R, patterns similar to the basic pattern 902R in FIG. 9 are formed. Note that a first image group of the four basic patterns 1501R, 1502R, 1503R, and 1504R may also be like the first image group of the second embodiment. In the present embodiment, the interval La between basic patterns is set to half of the interval in the first embodiment, that is, 2 Ld. Accordingly, the phases of the three groups of patterns included in each of the four basic patterns are the same phase, and by averaging the detection results of the twelve patterns, the AC color shift in the drum period and the drum half period can be reduced. Furthermore, in the present embodiment, since the interval La between the basic patterns is set to half of the interval in the first embodiment, the interval La has a value close to an interval of ¼ of the belt period. Accordingly, the AC color shift from the belt period can be averaged in four phases, and the AC color shift of the belt period can be effectively reduced. Furthermore, in the present embodiment, because the average of a total of 12 patterns is used, misregistration can be more effectively reduced even in a case where the waveform of the AC color shift does not have the form of a sine wave.

SUMMARY

In the above description, the image forming apparatus forms a detection pattern in which a plurality of basic patterns are arranged at a predetermined interval (a first interval) in the sub scanning direction. Each of the plurality of basic patterns includes N image groups (N being an integer of at least 3) arranged at a predetermined interval (a second interval) in the sub scanning direction. Here, in the N image groups, a first image group including a linear image at a first angle relative to a sub scanning direction, and a second image group including a linear image at a second angle different from the first angle, are arranged alternately in the sub scanning direction. As one example, the first angle is 45 degrees and the second angle is −45 degrees. Also, as one example, the first angle is 90 degrees and the second angle is −45 degrees. However, other angles can also be used.

Here, it is presumed that an AC color shift occurring in a first period, which is the rotation period of a rotational member included in a forming unit configured to form an image on an image carrier, is suppressed. For example, it is presumed that an AC color shift occurring in the first period, which is the rotation period of a photosensitive member or a motor configured to drive the photosensitive member, is suppressed. Note that a movement distance of the surface of the image carrier in the period of a first period is defined as a first distance. In the above example, the first distance corresponds to the drum period Ld=108 (mm). In this case, the first interval is M (M being an integer of at least 2) times the first distance, and the second interval is set to 1/(N−1) of the first distance. Note that the value of M is decided based on a comparison of the first distance to a value obtained by dividing the circumference of the image carrier by a positive integer. Also, the quantity of basic patterns to be formed is decided by the divisor of the circumference of the image carrier when deciding the value of M. Therefore, an AC color shift occurring due to rotational unevenness of the image carrier can also be suppressed.

The engine control unit 301 that performs misregistration correction control sets an adjacent first image group and second image group respectively as one group for each basic pattern of the detection pattern. Accordingly, (N−1) groups exist in one basic pattern. The engine control unit 301 calculates a misregistration amount from the respective detection results of (N−1) groups for one basic pattern. Also, the misregistration amounts of the (N−1) groups of each of the plurality of basic patterns are averaged to calculate the misregistration amount from the detection pattern.

Note that in the example in FIG. 9, the first formed image group of the basic pattern 901R is the first image group, and the first formed image group of the basic pattern 902R is the second image group. In this way, also with respect to the first formed image group of adjacent basic patterns, the precision of detecting the misregistration amount can be improved by alternately arranging the first image group and the second image group. However, the first formed image group of the basic pattern can be used as the first image group or the second image group.

Note that in the above embodiment, in order to suppress an AC color shift occurring due to rotational unevenness of the image carrier, a plurality of basic patterns are formed, but a configuration may also be adopted in which only one basic pattern is formed. As described in the above embodiments, one image group is used in both of two different patterns, so many groups of patterns can be formed in a limited area even with one basic pattern, and therefore, a harmonic component of the AC color shift can be efficiently suppressed.

Note that in each of the embodiments described above, in the basic pattern, two different image groups are alternately arranged. However, it is also possible to use three or more image groups at different angles. For example, it is possible to use a first image group at an angle of 45 degrees relative to the sub scanning direction, a second image group at an angle of −45 degrees, and a third image group at 90 degrees. More commonly, one basic pattern can be configured with N image groups of an Nth image group (N being an integer of at least 3) from the first image group arranged in the sub scanning direction. Here, it is presumed that a k-th image group (k being an integer from 1 to N) can be configured with linear images of each color at a k-th angle relative to the sub scanning direction. In this case, it is sufficient that an i-th angle (i being an integer from 2 to N−1) is an angle different from an (i−1)-th angle and an (i+1)-th angle. The reason for this is that when the angle of a particular image group is the same as the angle of an adjacent image group, the misregistration amount in the main scanning direction cannot be determined. Also, in the case of forming a plurality of basic patterns, the image groups within each basic pattern do not need to be the same.

Furthermore, together with the detection pattern for the misregistration correction processing described in each of the above embodiments, a density detection pattern for density correction can be formed on the transfer belt 27. In this case, the CPU 303 performs misregistration correction control based on the detection results of the detection pattern, and performs density correction control based on the detection results of the density detection pattern. That is, the misregistration correction and the density correction are executed in one instance of calibration. As described above, in the detection pattern for misregistration correction processing, one image group is used in common between two patterns, so the length in the sub scanning direction can be shortened. Accordingly, for example, the density detection pattern can be formed in an area between the basic patterns, or before or after the detection pattern, or the like, and so misregistration correction control and density correction control can be performed efficiently.

OTHER EMBODIMENTS

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-097388, filed on May 13, 2016, which is hereby incorporated by reference herein in its entirety.

What is claimed is:

1. An image forming apparatus, comprising:

a forming unit configured to form a detection pattern on a rotationally drivable image carrier, the forming unit including a photosensitive member;

a detection unit configured to detect the detection pattern; and a control unit configured to perform misregistration correction control based on a detection result of the detection pattern by the detection unit, wherein the detection pattern includes a plurality of basic patterns arranged at a first interval in a sub scanning direction, which is a rotation direction of the image carrier, each of the plurality of basic patterns includes N image groups (N being an integer of at least 3) arranged at a second interval in the sub scanning direction, in the N image groups, a first image group including an image at a first angle relative to the sub scanning direction, and a second image group including an image at a second angle different from the first angle relative to the sub scanning direction, are arranged alternately in the sub scanning direction, the first interval corresponds to a distance that a surface of the image carrier moves in a period of M (M being an integer of at least 2) times a first period corresponding to a rotation period of a rotational member included in the forming unit, the second interval corresponds to a distance that the surface of the image carrier moves in a period of 1/(N−1) of the first period, the forming unit is further configured to form a toner image on the photosensitive member, and transfer the toner image from the photosensitive member to the image carrier, thereby forming the detection pattern on the image carrier, and the rotational member is the photosensitive member or a motor configured to drive the photosensitive member.

2. The image forming apparatus according to claim 1, wherein a value of M is decided by comparing a value obtained by dividing a circumference of the image carrier by a positive integer to a distance that the surface of the image carrier moves in the first period.

3. The image forming apparatus according to claim 2, wherein a number of the plurality of basic patterns is decided based on a divisor of the circumference of the image carrier when the value of M was calculated.

4. The image forming apparatus according to claim 1, wherein the control unit is further configured to calculate, for each of (N−1) groups of the first image group and the second image group adjacent in each basic pattern of the plurality of basic patterns, a misregistration amount based on a detection result of the first image group and the second image group by the detection unit, and performs the misregistration correction control based on a value obtained by averaging misregistration amounts of the (N−1) groups of each of the plurality of basic patterns.

5. The image forming apparatus according to claim 1, wherein the first image group includes, for each of a plurality of colors, a linear toner image at the first angle, and the second image group includes, for each of the plurality of colors, a linear toner image at the second angle.

6. The image forming apparatus according to claim 1, wherein the first image group and the second image group are linearly symmetrical relative to the sub scanning direction.

7. The image forming apparatus according to claim 1, wherein the first angle is 90 degrees.

8. The image forming apparatus according to claim 1, wherein when a first formed image group of a front side basic pattern of two basic patterns that are adjacent in the sub scanning direction among the plurality of basic patterns is the first image group, a first formed image group of a rear side basic pattern is the second image group, and when a first formed image group of a front side basic pattern of two basic patterns that are adjacent in the sub scanning direction among the plurality of basic patterns is the second image group, a first formed image group of a rear side basic pattern is the first image group.

9. The image forming apparatus according to claim 1, wherein the second interval is a distance between adjacent image groups at a predetermined position in a main scanning direction orthogonal to the sub scanning direction.

10. The image forming apparatus according to claim 1, wherein the forming unit is further configured to form a density detection pattern between two adjacent basic patterns among the plurality of basic patterns, and the control unit is further configured to perform density correction control based on a detection result of the density detection pattern.

11. An image forming apparatus, comprising:

a forming unit configured to form a detection pattern on a rotationally drivable image carrier, the forming unit including a photosensitive member;

a detection unit configured to detect the detection pattern; and a control unit configured to perform misregistration correction control based on a detection result of the detection pattern by the detection unit, wherein the detection pattern includes at least one basic pattern, each basic pattern includes N image groups (N being an integer of at least 3) arranged at a predetermined interval in a sub scanning direction, which is a rotation direction of the image carrier, in the N image groups, a first image group including an image at a first angle relative to the sub scanning direction, and a second image group including an image at a second angle different from the first angle relative to the sub scanning direction, are arranged alternately in the sub scanning direction, the predetermined interval corresponds to a distance that a surface of the image carrier moves in a period of 1/(N−1) of a first period corresponding to a rotation period of a rotational member included in the forming unit, the control unit is further configured to calculate, for each of (N−1) groups of the first image group and the second image group adjacent in the basic pattern, a misregistration amount based on a detection result of the first image group and the second image group by the detection unit, and performs the misregistration correction control based on a value obtained by averaging misregistration amounts of the (N−1) groups of the at least one basic pattern, the forming unit is further configured to form a toner image on the photosensitive member, and transfer the toner image from the photosensitive member to the image carrier, thereby forming the detection pattern on the image carrier, and the rotational member is the photosensitive member or a motor configured to drive the photosensitive member.

12. An image forming apparatus, comprising:

a forming unit configured to form a detection pattern on a rotationally drivable image carrier, the forming unit including a photosensitive member;

a detection unit configured to detect the detection pattern; and a control unit configured to perform misregistration correction control based on a detection result of the detection pattern by the detection unit, wherein the detection pattern includes a plurality of basic patterns arranged at a first interval in a sub scanning direction, which is a rotation direction of the image carrier, each of the plurality of basic patterns includes N image groups (N being an integer of at least 3) arranged at a second interval in the sub scanning direction, a k-th image group (k being an integer from 1 to N) includes an image at a k-th angle relative to the sub scanning direction, an i-th angle (i being an integer from 2 to N−1) is an angle different from an (i−1)-th angle and an (i+1)-th angle, the first interval corresponds to a distance that a surface of the image carrier moves in a period of M (M being an integer of at least 2) times a first period corresponding to a rotation period of a rotational member included in the forming unit, the second interval corresponds to a distance that the surface of the image carrier moves in a period of 1/(N−1) of the first period, the forming unit is further configured to form a toner image on the photosensitive member, and transfer the toner image from the photosensitive member to the image carrier, thereby forming the detection pattern on the image carrier, and the rotational member is the photosensitive member or a motor configured to drive the photosensitive member.

13. The image forming apparatus according to claim 12, wherein an angle of a first formed image group of a front side basic pattern of two basic patterns that are adjacent in the sub scanning direction among the plurality of basic patterns differs from an angle of a first formed image group of a rear side basic pattern of two basic patterns that are adjacent in the sub scanning direction among the plurality of basic patterns.

14. An image forming apparatus, comprising:

a forming unit configured to form a detection pattern on a rotationally drivable image carrier, the forming unit including a photosensitive member;

a detection unit configured to detect the detection pattern; and a control unit configured to perform misregistration correction control based on a detection result of the detection pattern by the detection unit, wherein the detection pattern includes at least one basic pattern, each basic pattern includes N image groups (N being an integer of at least 3) arranged at a predetermined interval in a sub scanning direction, a k-th image group (k being an integer from 1 to N) includes an image at a k-th angle relative to the sub scanning direction, an i-th angle (i being an integer from 2 to N−1) is an angle different from an (i−1)-th angle and an (i+1)-th angle, the predetermined interval corresponds to a distance that a surface of the image carrier moves in a period of 1/(N−1) of a first period corresponding to a rotation period of a rotational member included in the forming unit, the control unit is further configured to calculate, for each of (N−1) groups of two image groups adjacent in the basic pattern, a misregistration amount based on a detection result of an image group by the detection unit, and performs the misregistration correction control based on a value obtained by averaging misregistration amounts of the (N−1) groups of the at least one basic pattern, the forming unit is further configured to form a toner image on the photosensitive member, and transfer the toner image from the photosensitive member to the image carrier, thereby forming the detection pattern on the image carrier, and the rotational member is the photosensitive member or a motor configured to drive the photosensitive member.

* * * * *